United States Patent [19]

Binnie

[11] Patent Number: 4,513,487

[45] Date of Patent: Apr. 30, 1985

[54] SEAMING MACHINE FOR MUFFLERS

[75] Inventor: Kevin D. Binnie, Taren Point, Australia

[73] Assignee: K. D. Binnie Engineering Pty. Ltd., New South Wales, Australia

[21] Appl. No.: 519,558

[22] Filed: Aug. 2, 1983

[30] Foreign Application Priority Data

Aug. 4, 1982 [AU] Australia ..... PF5209

[51] Int. Cl.[3] ..... B23P 11/00

[52] U.S. Cl. ..... 29/243.5; 413/32; 29/509

[58] Field of Search ..... 29/243.5, 243.52, 509, 29/510, 511; 72/108, 110, 111; 413/31, 32, 33

[56] References Cited

U.S. PATENT DOCUMENTS

| | | | |
|---|---|---|---|
| 1,972,866 | 9/1934 | Butler | 413/33 |
| 1,996,382 | 4/1935 | Lange | 413/32 |
| 2,083,401 | 6/1937 | Ross | 413/32 |
| 2,271,153 | 1/1942 | Kronquest | 413/33 |
| 2,711,706 | 6/1955 | Gueffroy | 413/32 |

*Primary Examiner*—Leon Gilden

*Attorney, Agent, or Firm*—Ladas & Parry

[57] ABSTRACT

An apparatus to manufacture the casings for mufflers, the apparatus includes a central support to receive an end plate and side wall of the casing, and a metal deforming roller brought into contact with the end plate and side wall so as to cause deformation thereof to join the end plate to the side wall, and means to move said roller into contact with the casing so that the roller will follow the general configuration of the muffler being formed.

5 Claims, 7 Drawing Figures

SEAMING MACHINE FOR MUFFLERS

The present invention relates to apparatus to manufacture the outer casings of mufflers.

It is a disadvantage of known apparatus to manufacture muffler casings, that the apparatus is generally expensive and accordingly is not employed in areas where a high volume of mufflers is not required. Additionally this known apparatus are not employed in areas where insufficient capital investment is available.

It is the object of the present invention to overcome or substantially ameliorate the above disadvantages.

There is disclosed herein an apparatus to manufacture a metal casing by joining the periphery of an end plate and edge of a side wall encompases a hallow with an open end to be closed by said end plate, said apparatus comprising a base, a rotatable support mounted on the base and adapted to receive said end plate with said side wall having one end edge in abutting relationship with the periphery of said end plate, a pair of metal deforming assemblies also mounted the said base and spaced on opposite sides of said support, each assembly including a metal deforming roller to be moved into contact with said end plate and side wall so as to deform same in co-operation with said support, a rotatable profile cam and cam follower, said follower being operatively coupled to said deforming roller so that said deforming roller is moved in accordance with the profile of said cam in a direction towards said support, and drive means to rotate the support and cams in synchronism.

A preferred form of the present invention will now be described by way of example with reference to the accompanying drawings, wherein.

Muffler casings generally consist of two generally parallel spaced coextensive end plates which are joined by a generally cylindrical side wall. The side wall could be of circular or oval configuration in transverse cross section depending on the general configuration of the muffler required. The end plates are secured to the side wall by wrapping the extremities of the side wall about the periphery of the end plates. The side wall is formed of sheet metal preferably of the same material forming the end plates. End plates define a configuration which is consistant with the transverse cross section of the side wall. That is if the side wall defines a generally circular shape in transverse cross section, then the end plates are of circular configuration. Alternatively, if the side wall defines an oval shape in transverse cross section, then the end plates will also define an oval shape to co-operate with the shape of the side wall. To enable a successful joining of the side wall to the end plates, the side wall adjacent its extremities diverges outwardly so as to be of a general funnel shaped configuration. Additionally the end plates are concave inwardly relative to the side wall, so that the end plate has a peripheral flange to engage the peripheral edge of the side wall. Accordingly the end plates are nested within the side wall so as to form generally concave ends for the casing.

Figure 1:
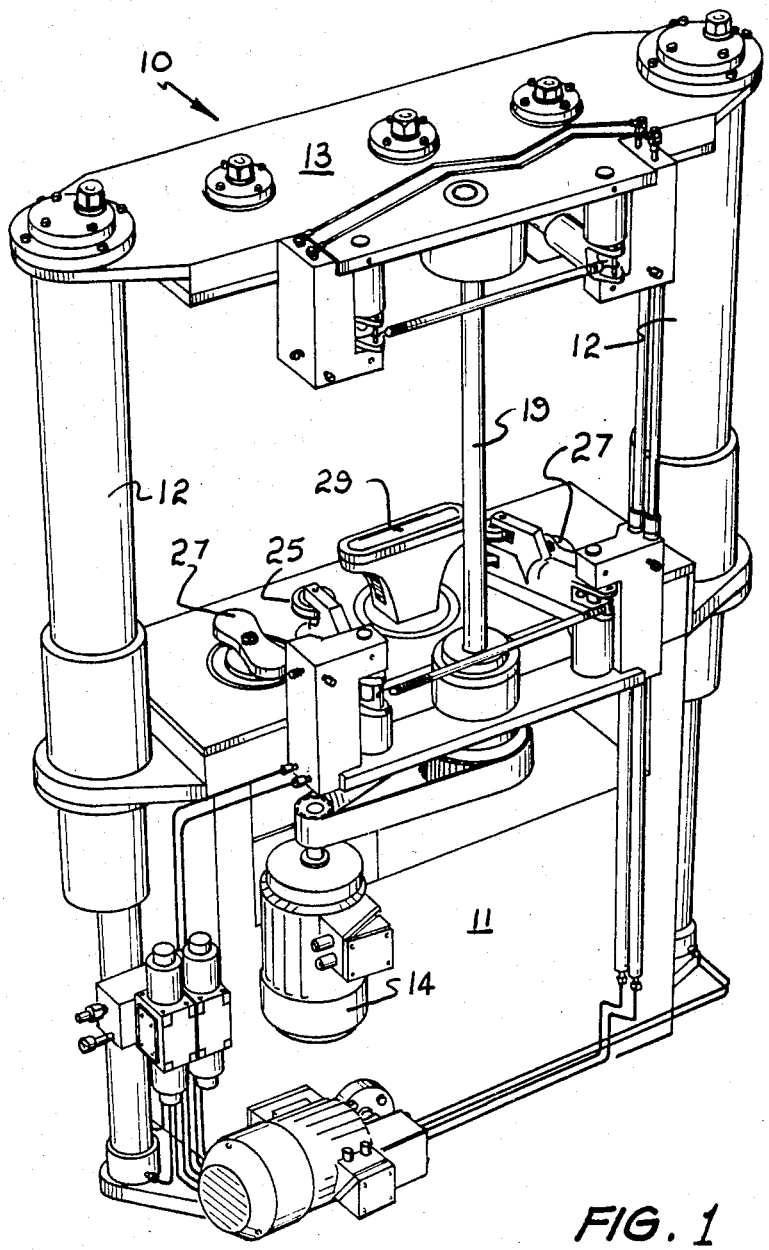
FIG. 1 is a schematic perspective view of an apparatus to manufacture mufflers.
Figure 2:
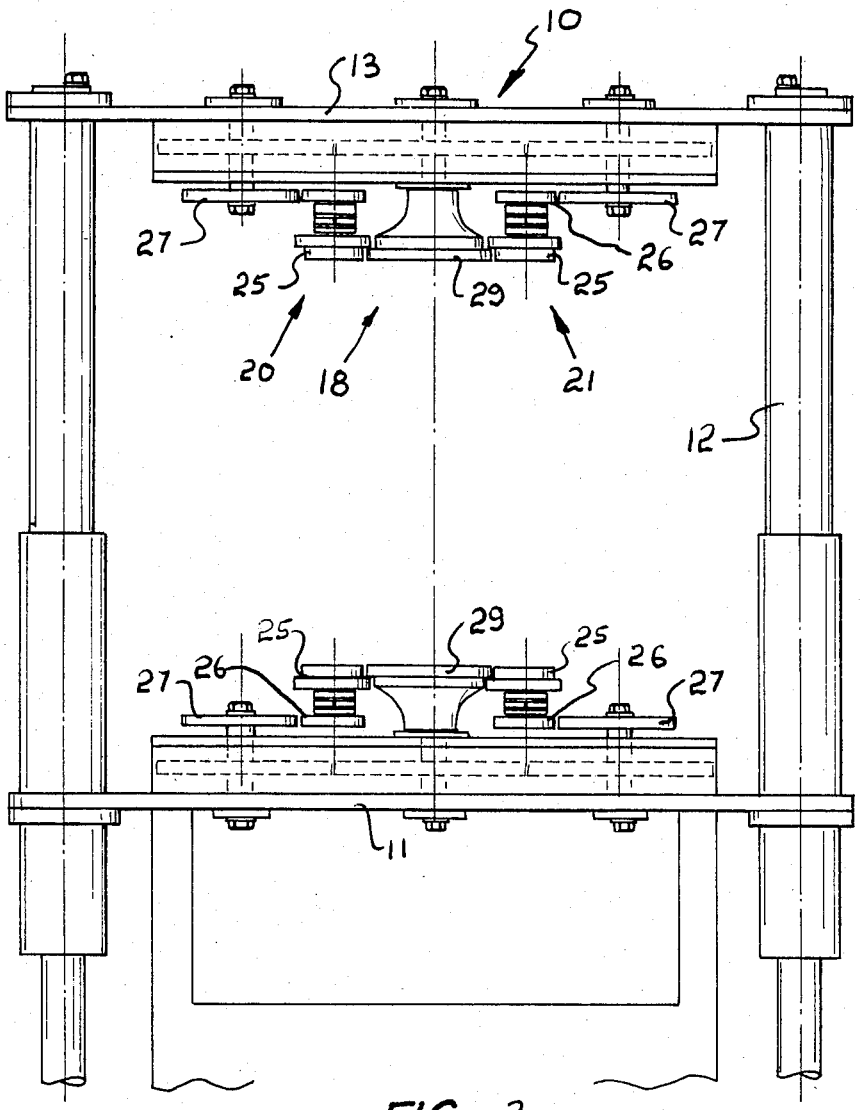
FIG. 2 is a schematic front elevation of the apparatus of FIG. 1.
Figure 3:
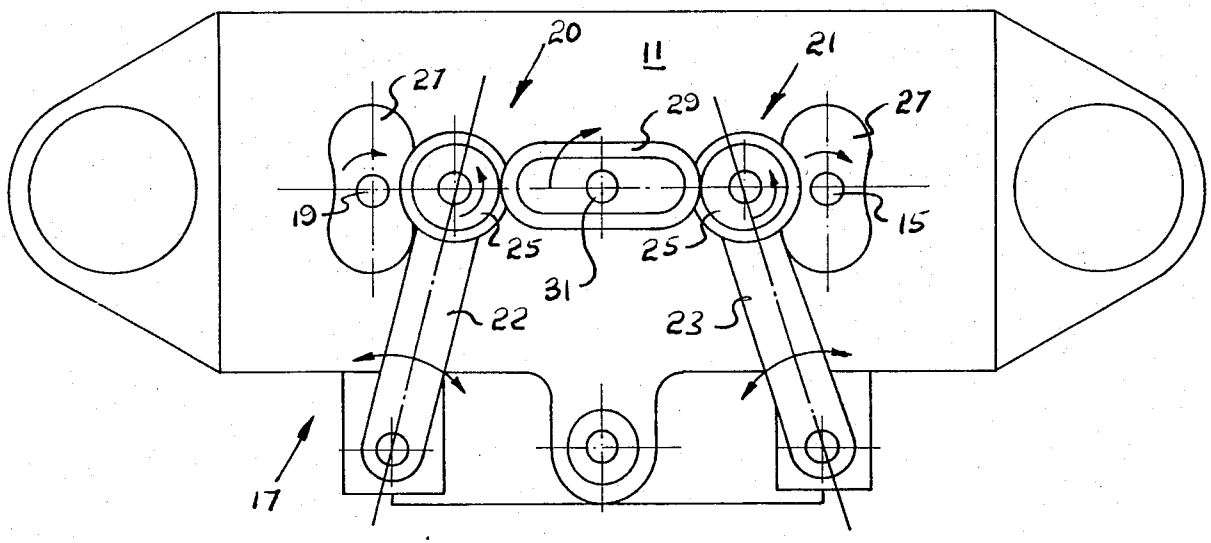
FIG. 3 is a schematic plan view of a portion of the apparatus of FIG. 1, which portion receives and forms the muffler casing.
Figure 5:
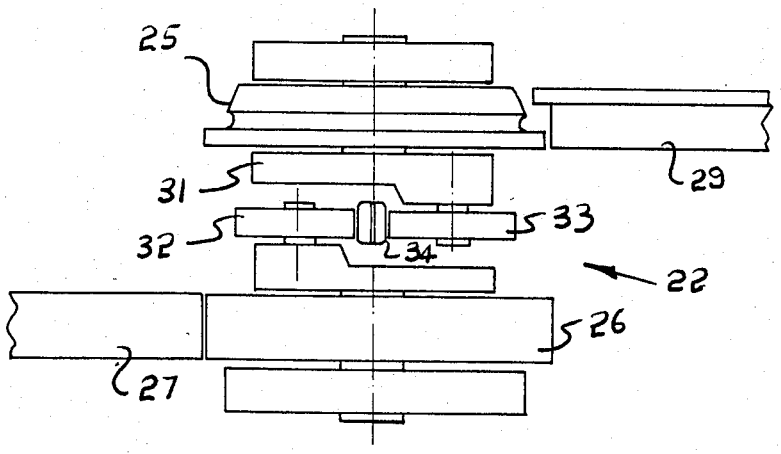
FIG. 5 is a schematic side elevation of a roller support assembly employed in the apparatus of FIG. 1.

In FIG. 1 there is schematically depicted an apparatus 10 to manufacture the casings for mufflers as described above. The apparatus 10 includes a main frame having a base 11 from which extends two vertical hydraulic cylinders 12. The cylinders 12 movably support an upper sub-frame 13 which is movable vertically by operation of the cylinders 12. The base 11 and sub-frame 13 are each provided with metal deforming assemblies 17 and 18 which engages the muffler end plates and side wall so as to cause deformation of their extremities to secure the side wall and end plates together. The assemblies 17 and 18 are identical and are vertically aligned.

The metal deforming assembly 17 is driven by means of a motor 14, while additionally there is extending between the two metal deforming assemblies 17 and 18, a drive shaft 19 which transmits power from the lower metal deforming assembly 17 to the upper metal deforming assembly 18.

Now with particular reference to FIGS. 2 to 7, wherein the metal deforming assembly 17 is more fully depicted. The metal deforming assembly 17 includes two sets of rollers 20 and 21 with each set 20 and 21 being attached to a pivotally mounted arm 22 or 23. The arms 22 and 23 are pivotally attached by means of pins to the base 11. Each arm 22 or 23 includes a base portion 30 which movably supports a sub-portion 31 with the portion 30 and sub-portion 31 each being provided with an idler roller 32 or 33. It should be appreciated that the sub-portion 31 is movably mounted on the base portion 30 so that the two idler rollers 32 and 33 are movably radially toward or away from each other. Also mounted on the base portion 30 is a longitudinally movable wedge 34 which is movable between the idler rollers 32 and 33 so as to cause relative radial movement therebetween. Rotatably mounted on the base portion 30 is a further roller 26 while rotatably supported on the sub-portion 31 is a metal deforming roller 25. The metal deforming assembly 17 further includes a central support 29 which receives the muffler side wall together with one of the end plates. The end plate is located on the support 29 so as to be concave downwardly with the side wall being placed on the end plate so as to extend upwardly therefrom. Accordingly the flanged peripheral edge of the end plate and the peripheral edge of the side wall are in abutting relationship. Also rotatably mounted on the base 11 are two profiled cams 27 which are rotatable about shafts 15 and 19 which extends generally parallel to the rotational axis of the support 29. The cams 27 are positioned to be engaged by the rollers 26 which act as cam followers so that the rollers 26 cause movement of the arms 22 and 23 in accordance with the profile of the cams 27. The support 29 is rotatably mounted on the base 11 by means of a shaft 31. Additionally the shaft 31 and shafts 15 and 19 are drivingly synchronized so as to be rotated with the same angular veloscity with the shaft 31 being rotated in the opposite direction to the shafts 19 and 30. The synchronism of the shafts 19 and 30 can be achieved by means of a gear train.

Figure 4:
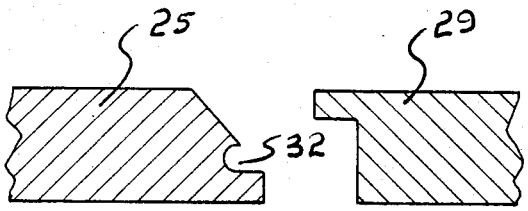
FIG. 4 is a schematic sectioned side elevation of the profiles of rollers employed in the apparatus of FIG. 1.
Figure 6:
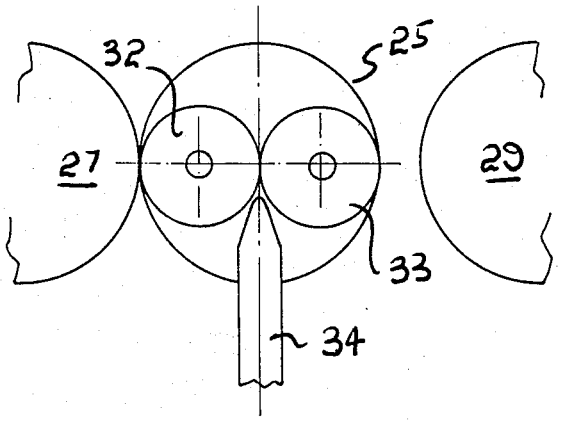
FIGS. 6 and 7 schematically depict in plan view actuation of the rollers employed in the apparatus of FIG. 1.
Figure 7:
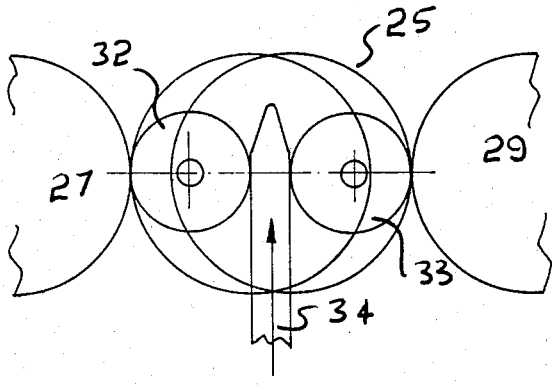

Turning now to FIG. 4 wherein the profile of the rollers 25 and support 29 are depicted. In operation the diverging ends of the side wall and the flanged peripheral edge of the end plates is sandwiched between the rollers 25 and the support 29 so that the edge of the side wall and the flanged edge of the end plate are both located facing the groove 32. As the roller 25 is moved toward the support 29 under the influence of the relative movement between the idler rollers 16, the edge of the side wall and the peripheral flange of the end plate are caused to fall back upon themselves and to be secured together to form a seam along the edge of the casing. It should be appreciated that the muffler is formed by being mounted on the support 29 and the support 29 being rotated in sychronism with the cams 27. Additionally the cams 27 provide for the application of force to roller 25 via the rollers 26. By rotation of the cams 27 in synchronism with the support 29, the metal deforming rollers 26 follow the general outline of the muffler to be formed. The profile of the cams 27 would be altered (by cam replacement) to suit the configuration of the muffler to be formed.

In operation of the above described apparatus 10, and end plate is located on the lower support 29 and the side wall plates thereon. Then the upper end plate is placed on top of the side wall. Thereafter the cylinders 12 are operated so as to bring the upper metal deforming assembly 18 into contact with the top of the side wall and top end plate. Thereafter the metal deforming assemblies 17 and 18 are then actuated to secure the end plates to the side wall.

What I claim is:

1. An apparatus to manufacture a metal casing having a side wall and end plate secured thereto by a seam joining the periphery of the end plate to an edge portion of the side wall, said apparatus comprising a base, a rotatable support mounted on the base and adapted to receive said end plate with said edge portion in abutting relationship with the periphery of said end plate, a pair of metal deforming assemblies also mounted the said base and spaced on opposite sides of said support; each assembly including a metal deforming roller to be moved into contact with said end plate and edge portion so as to deform same in co-operation with said support to form said seam, a cam rotatable about a fixed axis and having a cam profile, a movably mounted rotatable cam follower to engage said profile, said follower being operatively coupled to said deforming roller so that said deforming roller is moved in accordance with the cam profile in a direction towards said support, drive means to rotate the support and each cam in synchronism; and wherein each follower and its associated roller are located between the support and their associated cam and have a common support means movably mounting them on said base.

2. The apparatus of claim 1 wherein each common support means includes a pivotally mounted arm consisting of a base portion and a sub-portion movably related to said base portion, and wherein the metal deforming roller of each assembly is rotatably supported on its associated sub-portion with the associated cam follower mounted on the associated base portion.

3. The apparatus of claim 2 wherein each metal deforming assembly further including a pair of idler rollers one mounted on its associated base portion and the other mounted on the associated sub-portion, and wedge means to cause relative movement between each pair of associated idler rollers so as to move their associated metal deforming roller toward said support in addition to movement resulting from the profile of said cam.

4. The apparatus of claim 1, further including a sub-frame mounted above said base, a further rotatable support mounted on said sub-frame in axial alignment with the rotatable support mounted on said base, and a further pair of metal deforming assemblies spaced on opposite sides of said further support, so that a further end plate may be secured to said side wall at the opposite end to the other end plate, and drive means coupling the two metal deforming assemblies.

5. The apparatus of claim 1 wherein the rotational axes of the rollers, cams, cam followers and support are located generally with common plane.

* * * * *